US005499016A

United States Patent [19]

Pantus

[11] Patent Number: 5,499,016

[45] Date of Patent: Mar. 12, 1996

[54] INTRUSION ALARM SYSTEM

[75] Inventor: Mathias M. J. Pantus, Brunssum, Netherlands

[73] Assignee: Aritech B.V., Roermond, Netherlands

[21] Appl. No.: 19,480

[22] Filed: Feb. 17, 1993

[30] Foreign Application Priority Data

Feb. 17, 1992 [NL] Netherlands ..... 9200283

[51] Int. Cl.[6] ..... G08B 13/18

[52] U.S. Cl. ..... 340/555; 250/222.1; 340/506; 340/521; 340/567; 340/693

[58] Field of Search ..... 340/565, 567, 340/555, 556, 521, 522, 541, 506, 552–554, 693; 250/221, 342, 222.1; 367/93–94; 342/27–28; 359/355, 356, 580, 581; 356/338, 341

[56] References Cited

U.S. PATENT DOCUMENTS

| | | | |
|---|---|---|---|
| 3,703,718 | 11/1972 | Berman | 340/567 |
| 4,321,594 | 3/1982 | Galvin et al. | 340/567 |
| 5,243,326 | 9/1993 | Disabato | 340/555 |

FOREIGN PATENT DOCUMENTS

| | | | |
|---|---|---|---|
| 0186226 | 7/1986 | European Pat. Off. . | |
| 0189536 | 8/1986 | European Pat. Off. . | |
| 0255812 | 2/1988 | European Pat. Off. . | |
| 0289621 | 11/1988 | European Pat. Off. . | |
| 2141228 | 12/1984 | United Kingdom | 340/555 |

*Primary Examiner*—Thomas Mullen
*Attorney, Agent, or Firm*—Stoel Rives

[57] ABSTRACT

An obstruction resistant alarm system for detecting the presence of an intruder includes a housing (2) having a selectively transmissive window (1) that transmits radiation within a first wavelength range and scatters radiation within a second wavelength range. An intrusion sensor positioned to receive from an intruder radiation of wavelengths within the first wavelength range that pass through the window produces a presence signal that indicates the presence of the intruder. A radiation source (20) is positioned to direct radiation within the second wavelength range to strike and then be scattered by the window. A radiation detector (21) is positioned to detect the radiation striking and scattered by the window. The radiation emitted by the radiation source and scattered by the window forms a normal radiation pattern having a normal intensity whenever the window is unobstructed and forms an abnormal radiation pattern with an abnormal intensity whenever the window is obstructed. An alarm circuit (19) produces an alarm signal whenever the radiation detector detects radiation intensity corresponding to an abnormal radiation pattern to indicate an obstruction of the window and a consequent compromise to the reliability of the presence signal produced by the intrusion sensor.

10 Claims, 9 Drawing Sheets

INTRUSION ALARM SYSTEM

BACKGROUND OF THE INVENTION

The present invention relates to an intrusion alarm system provided with a passive sensor with a detector for detecting light energy (electromagnetic radiation) from an object in a location to be monitored, and with an alarm for generating an alarm signal, dependent on whether a detection signal is emitted by the detector or not.

Such an intrusion alarm system is known from European patent application No. 0 255 812 in the name of Elkron S.p.A. The intrusion alarm system described therein utilizes, in a well-known manner, a passive infrared sensor, whereby infrared light emitted by an object in a location to be monitored is passed by optical means—via an entrance of a passive infrared sensor—to a detector in the form of, for example, a pyro-electric element. The optical means can, for example, consist of a mirror or a Fresnel lens. An intruder in the location to be monitored is spotted as a result of the pyro-electric element detecting a change, generated by the intruder, in the amount of infrared light falling thereon and consequently activating an alarm, which alarm generates an alarm signal. In order to optimize the operation of the known intrusion alarm system the aforesaid European patent application proposes to couple the passive infrared sensor to a radio frequency sensor operating in the UHF band. With the known intrusion alarm system an alarm signal is not initiated unless both the passive infrared sensor and the radio frequency sensor, independently, detect an intruder in the location to be monitored. While the detection operation of the passive infrared sensor is already outlined above, the detection operation of the radio frequency sensor is in broad outline as follows. Movements made by an intruder in a location to be monitored, in which radio waves are emitted, cause a disturbance of the radio frequency band (as a result of the Doppler effect), which disturbance is detected by the radio frequency sensor, resulting in an alarm signal being generated.

Such an intrusion alarm system is also known from Berman U.S. Pat. No. 3,703,718. The infrared intrusion alarm system described therein utilizes a single passive sensor and optical means for focusing radiation directed at the passive sensor from various fields of vision in a location to be monitored. An amplifier, which is arranged so as to have a frequency response corresponding with the walking speed of an intruder, amplifies the signal from the passive sensor. The amplifier is provided with means for distinguishing between changes in the infrared radiation that are caused by the presence of an intruder and changes caused by gradual temperature changes, such as changes in the room temperature and the ambient temperature.

One drawback of the known intrusion alarm system is that it does not offer a solution for the following problem. Since the operation of the passive infrared sensor is based on the detection of infrared light, i.e. heat radiation with a wavelength in the order of in particular approximately 6–18 μm, emitted by an intruder in a location to be monitored, and since only very few materials possess good transmission characteristics for such infrared light (nearly all materials block, absorb and/or reflect this kind of light), the detection of the known intrusion alarm system can be easily sabotaged by placing materials that possess poor transmission characteristics for this kind of infrared light on and/or near the detector of the passive infrared sensor. When, for example, at least part of the receptor of the passive infrared sensor is blocked with materials such as paper, glass, paint, cardboard or plastic, the monitoring ability of the known intrusion alarm system is very detrimental. In some cases such sabotaging of the quality of the known intrusion alarm system can be carried out without this being clearly visible to the user of the intrusion alarm system, for example, in particular by placing a glass plate in front of the detector of the passive infrared sensor or by painting the window of the passive infrared sensor in a similar color. A further drawback of the intrusion alarm system known from European patent application No. 0 255 812 is that it is complex and relatively costly, in particular owing to the use of two separate sensors, and because no alarm signal is generated unless both the passive infrared sensor and the radio frequency sensor detect an intruder in the location to be monitored, so that, when one of the sensors does not function at all, or not optimally, no alarm signal is generated. The intrusion alarm system known from U.S. Pat. No. 3,703,718 appears to be rather prone to sabotage in practice.

The object of the invention is to provide a simple and inexpensive intrusion alarm system which makes it possible to detect sabotage to the passive sensor thereof.

SUMMARY OF THE INVENTION

According to the present invention, an intrusion alarm system provided with a passive sensor having a detector for detecting light energy (electromagnetic radiation) from an object in a location to be monitored, and including an alarm for generating an alarm signal dependent on whether a detection signal is emitted by the detector or not, includes an active sensor having at least one source for emitting light at least partially onto a window of the passive sensor and having at least one detector for detecting reflected light from the source. Preferably, the passive sensor is a passive infrared sensor and the active sensor is an active infrared sensor, based on the emission or detection of infrared light, respectively. Thus, an intrusion alarm system is provided which offers adequate security against sabotaging of the passive infrared sensor, such as by approaching the passive infrared sensor with a hand, covering the sensor with a glass pane, approaching the sensor with white paper, covering the passive infrared sensor with cardboard, spraying the sensor with clear varnish and/or covering the sensor with a foam plastic plate that absorbs infrared light.

It is noted that the intrusion alarm system according to the invention knows no restrictions with regard to the type of light being used, i.e. not only infrared light, but also visible light (for example, with a wavelength between 0.35 and 0.8 μm) may be used. From a marketing point of view it may even be interesting to use visible blue, green or red light. Furthermore, it is noted that an important advantage of the intrusion alarm system according to the invention is the fact that the active (whether or not infrared) sensor has a limited range, so that (e.g., sabotaging) manipulations on the window of the passive sensor and in the vicinity thereof are detected, whereas an authorized person when passing by the active sensor during the daytime does not generate an alarm signal.

One embodiment of an intrusion alarm system according to the invention is characterized in that an alarm is provided for generating an alarm signal in dependence on whether a detection indication is issued by the detector of the active infrared sensor or not. This alarm may be the alarm which is coupled, in an electromagnetic sense, to the passive infrared sensor; it may also be a separate alarm, however.

Another embodiment of an intrusion alarm system according to the invention is characterized in that the source can emit infrared light onto and around the window of the passive infrared sensor.

Another embodiment of an intrusion alarm system according to the invention is characterized in that the passive infrared sensor is sensitive to infrared light having a wavelength between 6 and 50 μm.

Another embodiment of an intrusion alarm system according to the invention is characterized in that the active sensor is sensitive to light having a wavelength between 0.35 and 4 μm.

Another embodiment of an intrusion alarm system according to the invention is characterized in that said source and said detector of the active infrared sensor at least substantially consist of a photoemitter and a photodiode, respectively, each having an angle of opening between 60° and 120°.

It is noted that the intrusion alarm system according to the invention may include a passive infrared sensor coupled to a radio frequency sensor, all this in accordance with Elkron S.p.A. European patent publication No. 0 255 812. It is furthermore noted that with the intrusion alarm system according to the invention the active (whether or not infrared) sensor may also include more than one source (photoemitter) and/or more than one detector (photodiode). The specific advantage of this is that the alarm of the intrusion alarm system is not activated when, for example, insects come near the window of the passive sensor. It is preferred that the sources and the associated detectors are sequentially driven in pairs in such an embodiment of the invention.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
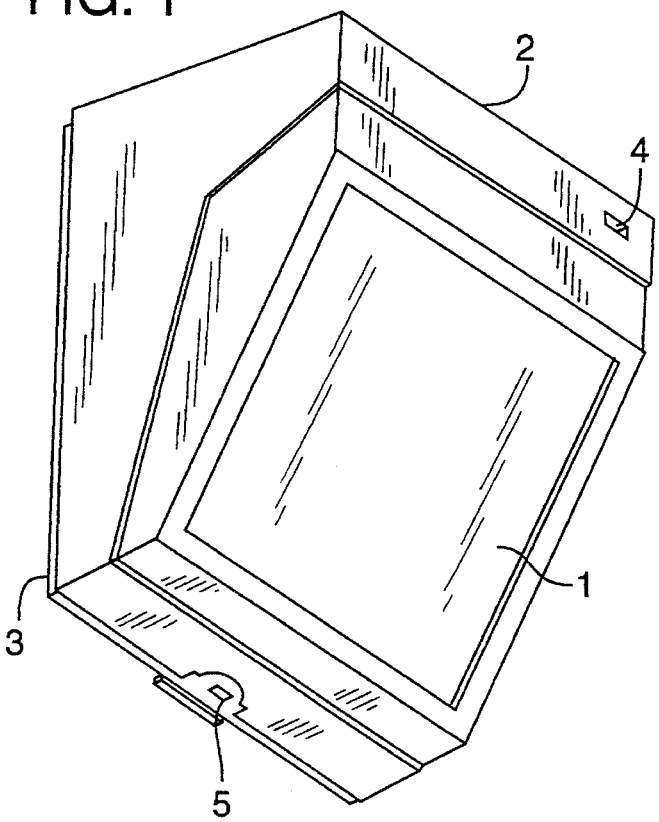
FIG. 1 is a perspective view of a housing of a passive infrared sensor associated with a prior art intrusion alarm system.

In FIG. 1 a housing of a passive infrared sensor associated with a prior art intrusion alarm system is shown, said housing including a window 1 for the detector of the passive infrared sensor, a cover 2, a mounting base 3, an alarm light 4 which will light up when the alarm is activated, and means of attachment 5 for securing the cover 2 and the mounting base 3 together.

Figure 2:
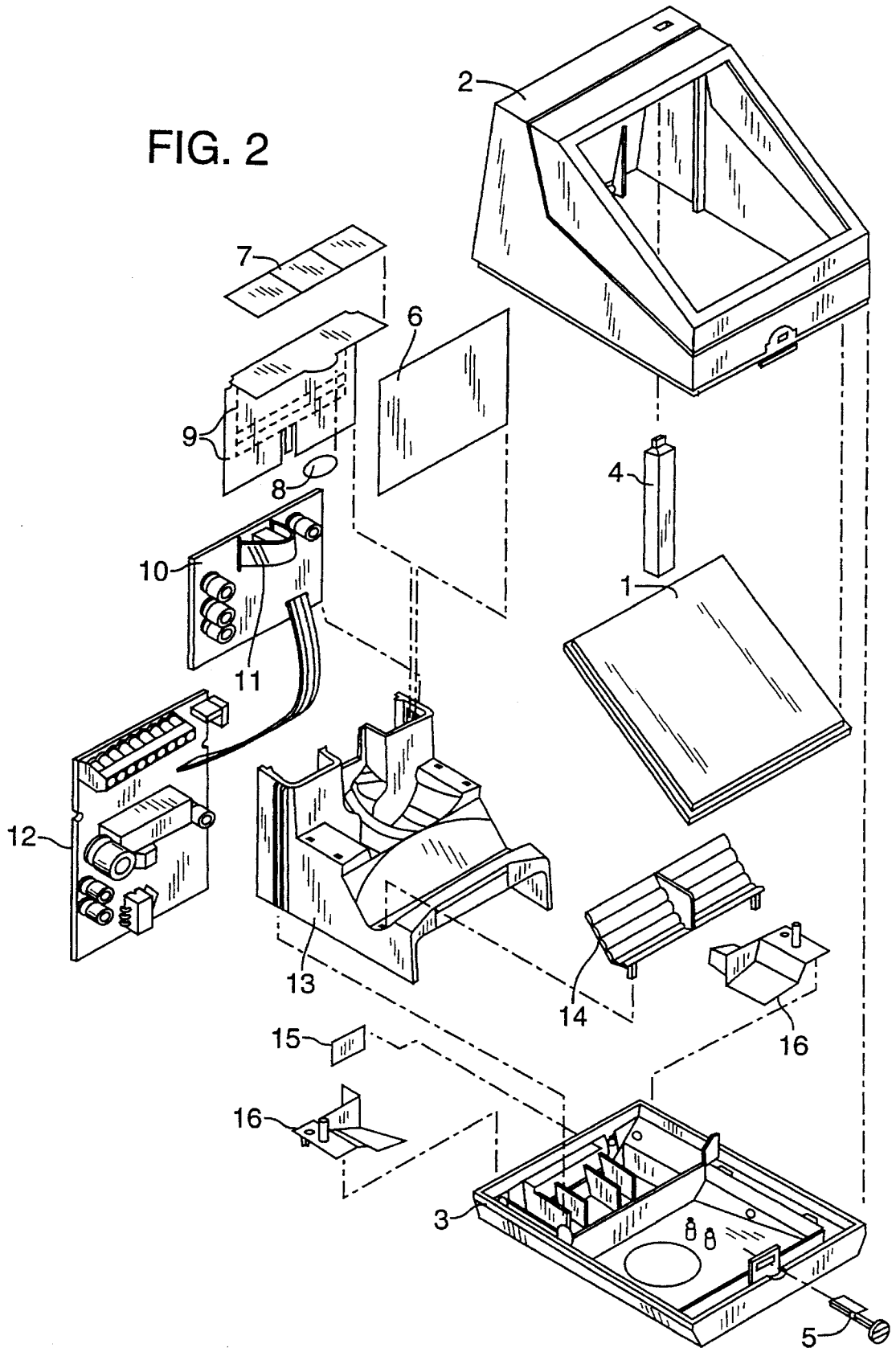
FIG. 2 is an exploded perspective view of the passive infrared sensor of FIG. 1.

FIG. 2 shows the passive infrared sensor of FIG. 1 in disassembled condition, whereby besides the aforesaid parts also the following parts are depicted: an insulation plate 6, a sticker 7 with connection data, an insulation sticker 8, a metal radio frequency shield 9, an amplifier circuitboard 10, a pyro-electric element 11 with a holding fixture, a circuitboard 12 with control functions, a far infrared focusing mirror 13, a masking plate 14 for long detection fields, a type-indication sticker 15, and masking plates 16 for short detection fields.

Figure 3:
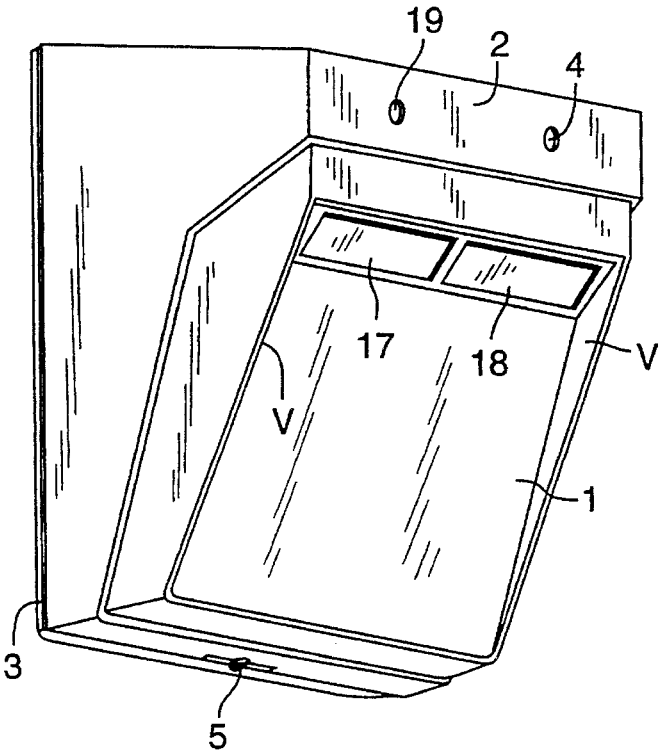
FIG. 3 is a perspective view of a housing of a passive infrared sensor associate with an intrusion alarm system according to the invention.

In FIG. 3 a housing of a passive infrared sensor associated with an intrusion alarm system according to the invention is depicted. Said housing includes a window 1 for the detector of the passive infrared sensor (which may be a thin layer of a plastics material such as a high density polyethylene having good transmission characteristics for the wavelength of energy to be detected by the passive infrared sensor), a cover 2, a mounting base 3, an alarm light 4, means of attachment 5 for securing the cover 2 and the mounting base 3 together, windows 17 and 18 for the source and the detector of the active infrared sensor, respectively, and an alarm light 19 which lights up when it is attempted to sabotage the passive infrared sensor. It is noted that from a purely technical point of view the windows 17 and 18 are not absolutely necessary, but in principle function to make the unit look more attractive.

Figure 4:
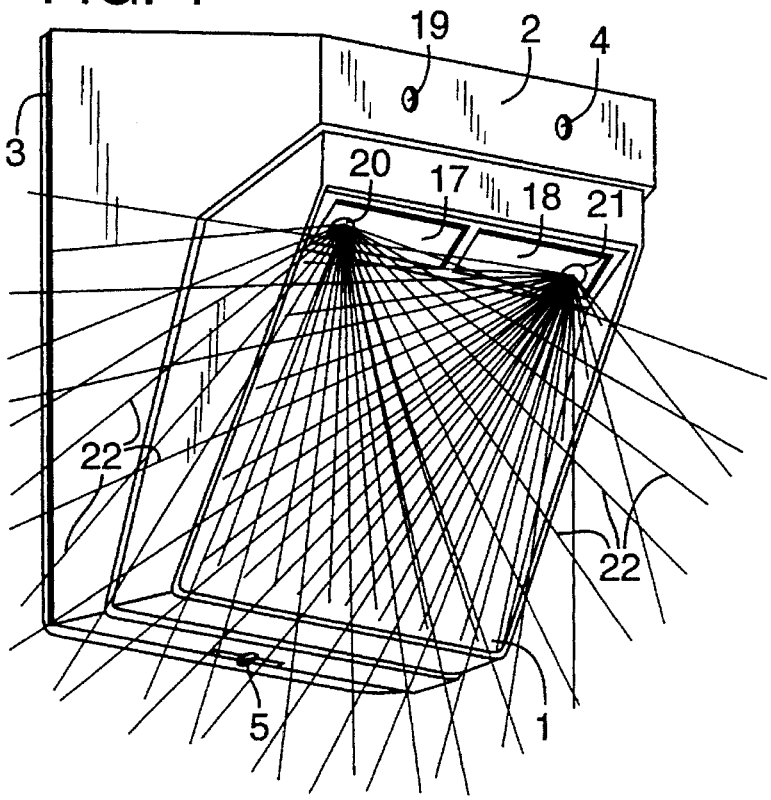
FIG. 4 is a perspective view of the housing shown in FIG. 3 wherein infrared radiation as emitted or received by the source or the detector of the active infrared sensor respectively is drawn in full lines.

In FIG. 4 the infrared radiation emitted by the source 20 or received by the detector 21 of the active infrared sensor, respectively, is illustrated in full lines 22.

Figure 5:
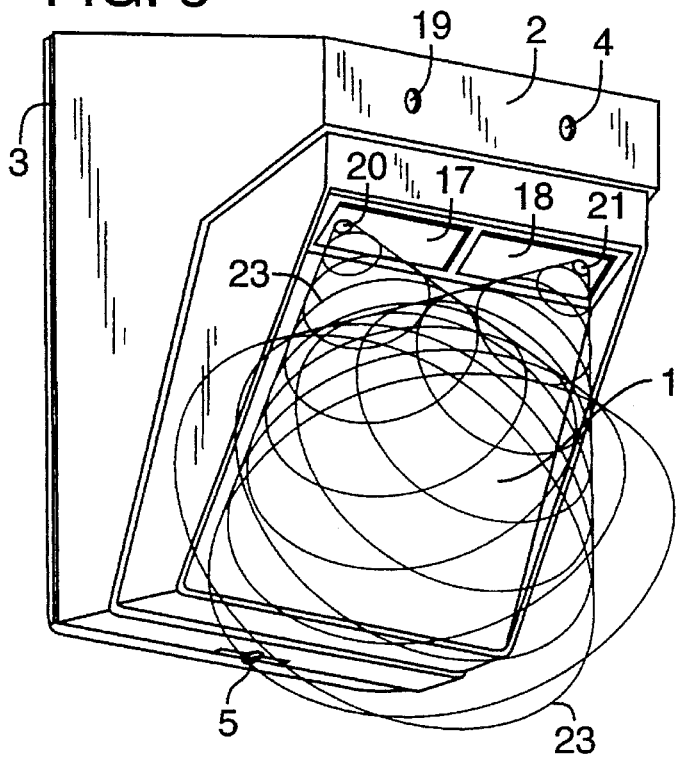
FIG. 5 is a perspective view of the housing shown in FIG. 3 illustrating an area covered by the active infrared sensor (with conical envelopes of emitted and received beams of infrared radiation).

FIG. 5 shows the area covered by the active infrared sensor with conical envelopes 23 of emitted and received beams of infrared radiation. Those parts in FIGS. 4 and 5 that correspond with parts shown in FIG. 3 are indicated by the same reference numerals. The full line and conical representations of infrared radiation depicted by FIGS. 4 and 5 represent a normal radiation intensity pattern that provides a corresponding normal amount of radiation intensity to detector 21.

Figure 6:
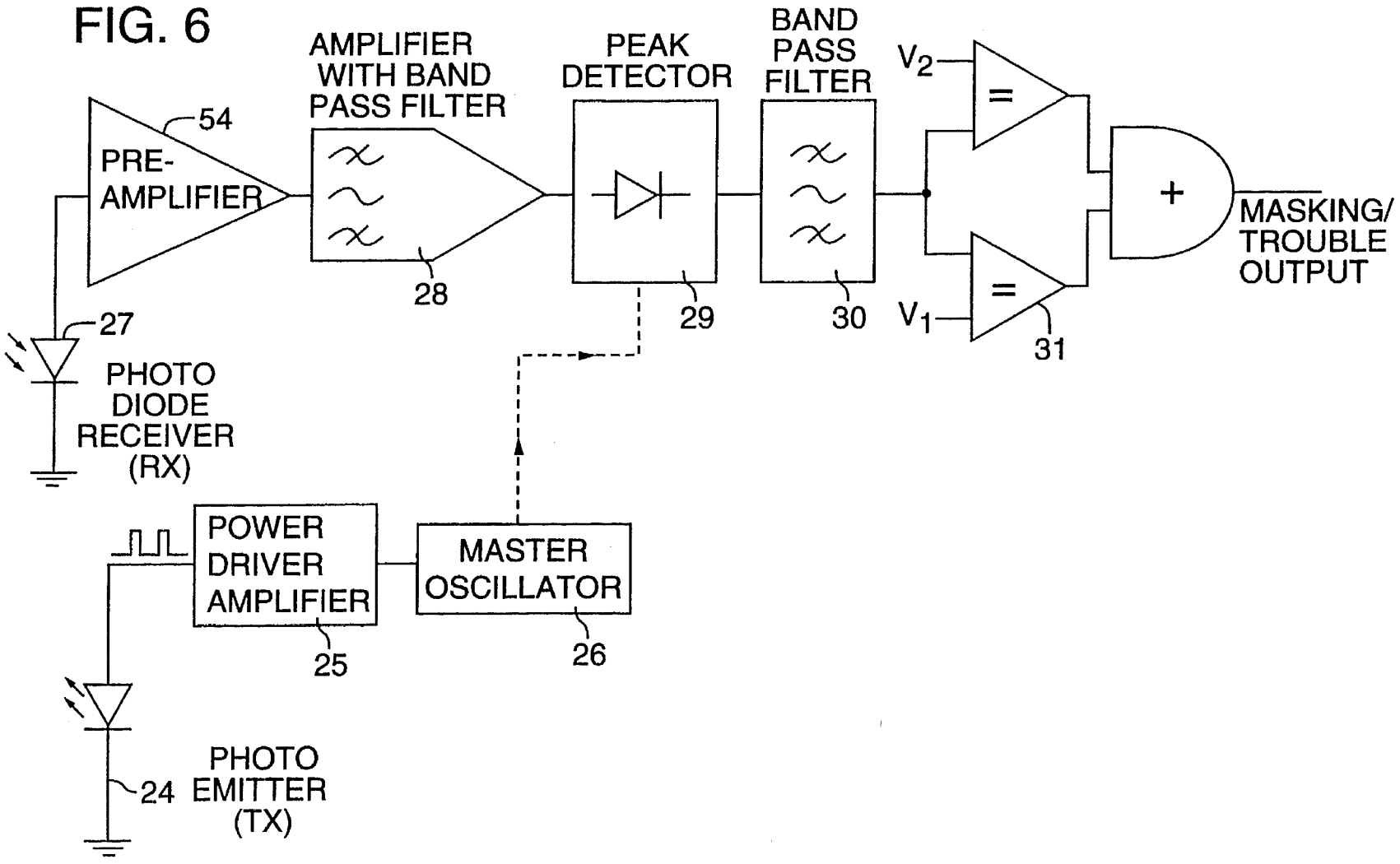
FIG. 6 is a schematic block diagram of an electric circuit of an intrusion alarm system according to the invention.
Figure 7A:
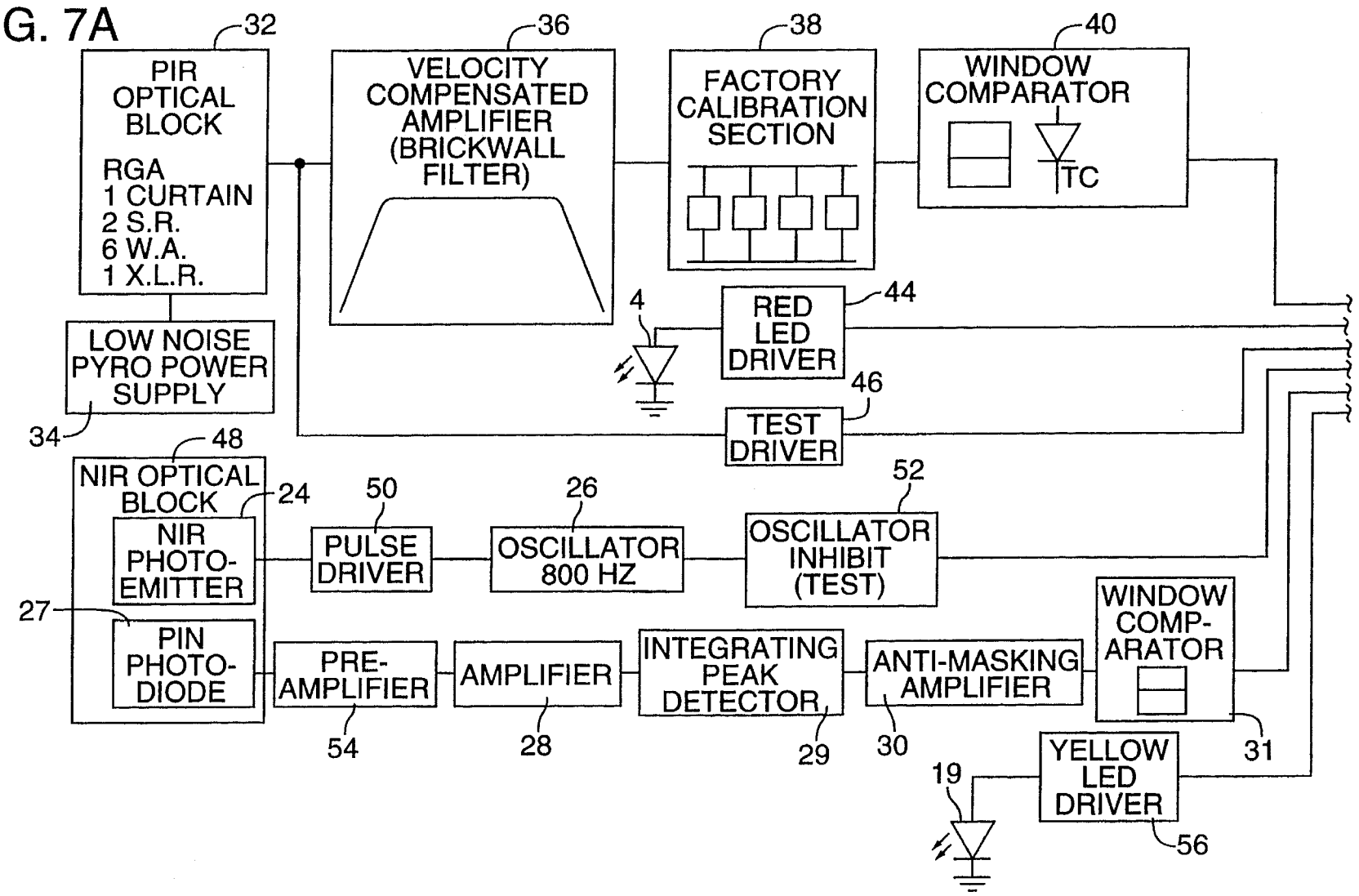
FIG. 7*a* is the left side portion of a block diagram of an infrared sensor according to the invention, and is to be viewed together with FIG. 7*b*.
Figure 7B:
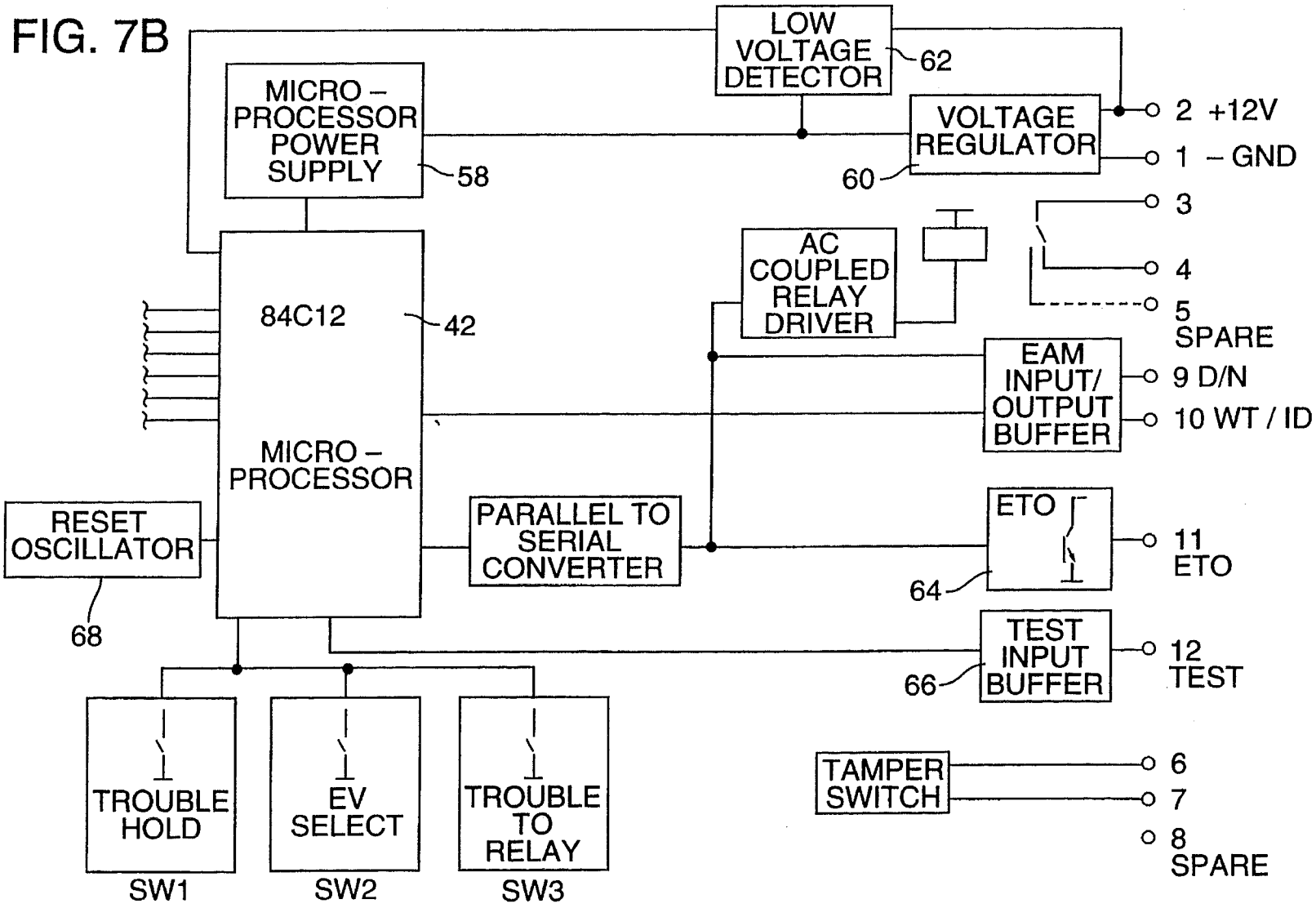
FIG. 7*b* is the right side portion of a block diagram of an infrared sensor according to the invention, and is to be viewed together with FIG. 7*a*.
Figure 8:
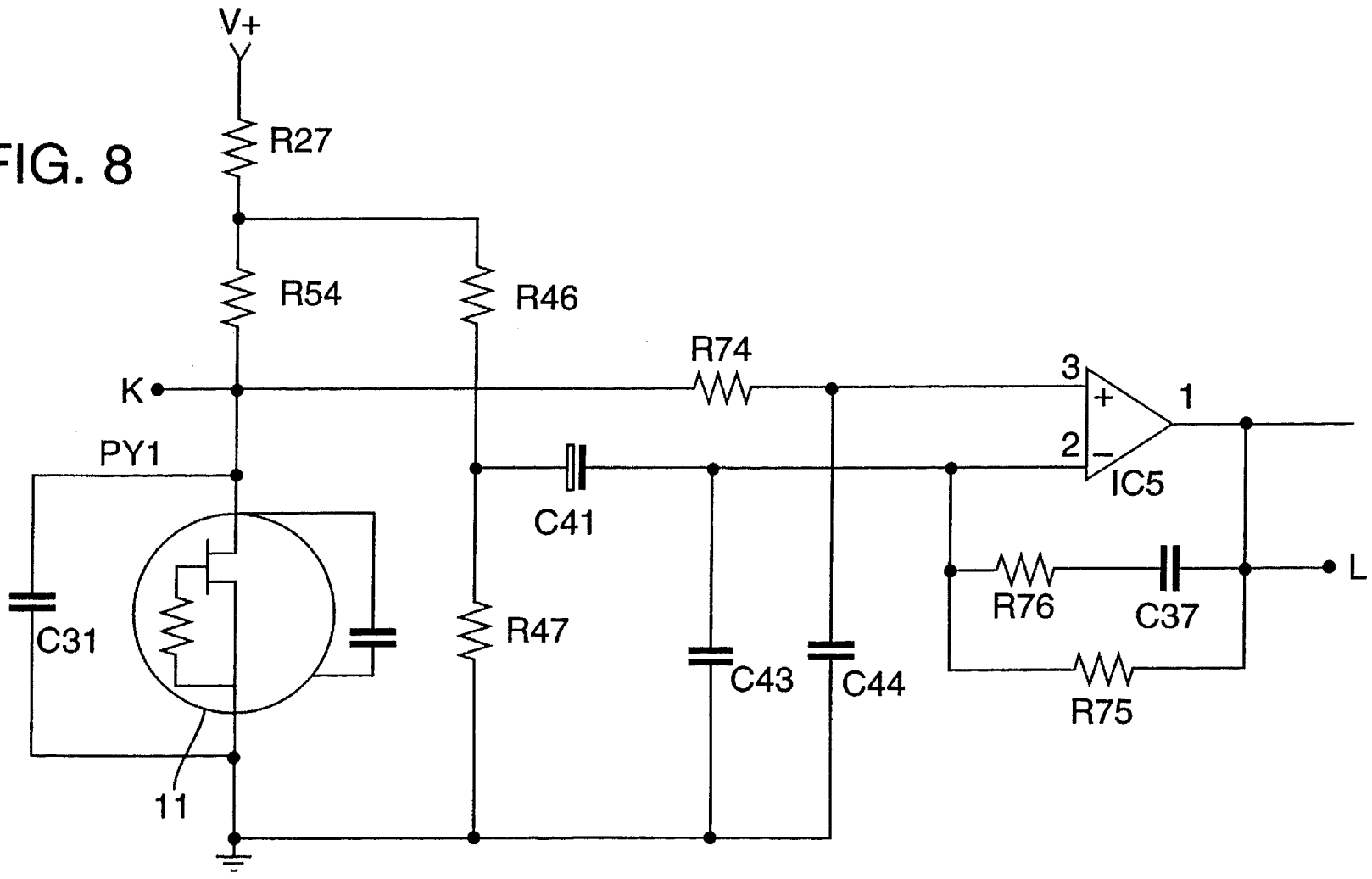
FIG. 8 is a schematic circuit diagram of a passive infrared pyro sensor forming a part of the sensor shown in FIGS. 7*a* and 7*b*.

The operation of the intrusion alarm system according to the invention will be explained in more detail with reference to the block diagram of FIG. 6 of an electric circuit of said intrusion alarm system.

The source of the active infrared sensor consists of a photoemitter 24 (near infrared transmitter (NIR-TX)) having an angle of opening between 60° and 120°, said photoemitter 24 emitting radiation in the near infrared wavelength range onto and around the window of the passive infrared sensor (see the preceding figures). The passive infrared sensor is actually sensitive to infrared light of the far infrared wavelength range. The photoemitter 24 is connected to a power driver amplifier 25, which generates pulse flows with peak currents in the order of about 1 A, so that the photoemitter 24 emits short infrared pulses at a high intensity. A master oscillator 26, with a pulse repetition time in the millisecond range and a pulse length in the microsecond range, provides the timing of the photoemitter 24. The aforesaid window 1 of the passive infrared sensor is preferably provided with a fine, not highly polished, surface texture, in such a manner that infrared light from the photoemitter 24 that falls thereon is scattered in numerous directions. The advantage of this is that a certain amount of background light is received by the detector 21 of the active infrared sensor at all times, so that a reference reflection signal of a constant low value is present at all times.

The detector 21 of the active infrared sensor consists basically of a photodiode 27 (near infrared receiver (NIR-RX)), likewise with an angle of opening between 60° and 120°, which photodiode 27 is receptive to infrared light scattered by the window 1 and adjacent wings (indicated at V in FIG. 3) of the passive infrared sensor, as well as by objects located in the immediate vicinity of the window 1.

Looking from the front of the sensor, the infrared emitter 24 is positioned at the right side and the photodiode 27 at the left side of the sensor, just above the passive far infrared (FIR) mirror section, which may be similar to the mirror 13 shown in FIG. 2. Both the photoemitter 24 and the receptor photodiode 27 of the detector 21 are oriented within a certain angle, so that they are focused upon the center of the bottom side of the window 1.

The photoemitter 24 and the photodiode 27 are placed, respectively, behind the two NIR-transparent windows 17 and 18, of General Electric Lexan™ 71257 black polycarbonate, for example, which are separated by a NIR non-transparent material, to distribute the light from the active semiconductors to the window 1 which may be of HDPE. The NIR windows 17 and 18 are separate to prevent transmission of any light directly from the photoemitter 24 to the photodiode 27. The two scattering ribs V at both sides of the FIR window 1 are used to create as many secondary paths as possible from the photoemitter 24 to the receiver photodiode 27. These ribs V reflect the signal over the window 1 and increase probability of detecting masking.

The photodiode 27 is connected to an amplifier/filter 28, which amplifies pulses at a high pulse repetition rate and which rejects signals having a low pulse repetition frequency, such as signals caused by fluctuations in the ambient light.

A peak detector 29 detects the peak amplitude of the fast infrared pulses received by the photodiode 27 and amplified by the amplifier/filter 28. In this connection it is noted that a system of transmitting and amplifying short infrared pulses with a high intensity has been opted for, on the one hand in order to conserve energy and on the other hand in order to retain the possibility of distinguishing the pulses emitted by the photoemitter 24 from fluctuations in the ambient light.

The peak detector 29 is followed by a bandpass filter 30 which amplifies only variations in the peak amplitude ranging from slow to very slow (0.001–1 Hz). This was opted for in order to filter out ultra-slow amplitude variations, such as caused in particular by ageing of used semiconductors or by thermal drift, and in order to keep detecting in a reliable manner the slow movement of objects towards the window 1 of the passive infrared sensor during an attempt at sabotage.

The peak detector 29 may be synchronized by means of the master oscillator 26. As a result of the addition of a synchronization signal the peak detector 29 will only be operative for a short time, during which a transmission pulse of the photoemitter 24 also takes place. As a result of this, the signal-noise ratio of the intrusion alarm system according to the invention will be improved considerably. The following improvements will be possible in that case: (a) a greater immunity to daylight (the system continues to operate in a reliable manner, even with direct incident sunlight); (b) a much smaller consumption of emitter current and yet an adequate functionality; and (c) greater reliability and a longer life of the intrusion alarm system due to the reduced load of active semiconductor devices.

A window comparator 31, with a logic alarm circuit which is linked to the band pass filter 30 connected thereto, is activated when predetermined limiting values are exceeded, which indicate that the quality of the intrusion alarm system according to the invention is affected as a result of an attempt at sabotage.

A low limiting value indicates that there is less scattering of infrared light in the direction of the photodiode 27. This points, for example, to changes with regard to the scattering by the aforesaid fine surface texture of the window 1 or by the aforesaid wings V, which may be caused by varnish or paint being sprayed on the window 1 of the passive infrared sensor. This will also be the case when the windows 17, 18 of the photoemitter 24 and the photodiode 27 are covered or when the photoemitter 24 of the photodiode 27 does not function optimally. The less scattering of infrared light in the direction of photodiode 27 resulting from an attempt at sabotage correlates to an abnormal radiation intensity pattern different from that represented in FIGS. 4 and 5 and a corresponding abnormal amount of radiation intensity received by photodiode 27.

A high limiting value indicates that a reflecting object must be present in the vicinity of the window 1, which object increases the amount of infrared light traveling from the photoemitter 24 to the photodiode 27. This will inter alia be the case when a glass pane is used to cover the detector of the passive infrared sensor or when an intruder attempts to cover the window 1 of the passive infrared sensor with his hands, a sheet of paper or a piece of plastic.

The sensitivity of the intrusion alarm system according to the invention with regard to the detection of reflecting materials, absorbent materials and attempts at spraying paint can be optimized by

- placing the photoemitter 24 and the photodiode 27 at an acute angle, in particular an angle of less than 20°, with respect to the window 1 of the passive infrared sensor;
- optimizing the characteristics of the fine surface texture on the window 1 of the passive infrared sensor, so that light scattered therefrom can be optimally transmitted to the photodiode 27;
- using more than one path along which infrared light can travel from the photoemitter 24 to the photodiode 27, especially by introducing wings V (see FIG. 3).

Referring to FIGS. 7*a*, 7*b*, 8, 9, and 10, a sensor embodying the invention is shown in additional detail.

The optical block 32 of the passive detector includes a pyro-electric sensor 11 and a precision mirror optical arrangement. The mirror defines one curtain, two short range zones, 6 wide angle zones and one long range zone. The power supply 34 for the pyro-electric sensor is built up around a special low noise zener diode for smoothing and regulating the voltage power for the pyro-electric sensor 11 out of the Voltage regulator block to be 5 V. maximum. The pyro-electric sensor 11 may be a number HGA sensor available from Nippon Ceramic Co., Ltd., for example.

To discriminate between moving targets and heat radiating from inanimate objects the output voltage from the pyro-electric element 11 is amplified in a velocity compensated amplifier 36. Because of the heat capacity of the pyro-electric element, the generated voltage of the output of the pyro-electric element will fluctuate dependent on the target velocity. For high speed targets the pyro-electric element heat capacity time constant will degrade the response. To compensate for heat capacity effects, a differentiating network allows the sensor to detect targets over a wide range of velocities independent of range. (See FIG. 8.)

A factory calibration section 38 permits compensation for the manufacturing tolerances of the pyro-electric element 11, which can vary about 6 dB. To eliminate sensitivity differences among individual sensors, the gain is calibrated at the factory. After calibration, a window comparator 40 will determine whether the PIR signals detected are large enough to generate an alarm.

A passive infrared sensor detects the differences between the target radiation and the background radiation. This radiation difference varies as a function of the ambient temperature. The window width "gap voltage" is made up by a special selected diode. The voltage of this diode is temperature dependent and thus causes the background temperature compensation to preserve a more consistent PIR detection characteristic. The output signal of the window comparator 40 is fed to the microprocessor 42. The necessary post threshold integration is performed by an integration algorithm in the microprocessor 42.

For indicating the first and second alarm and walk testing the red LED 4 is located to be visible by means of a hole in the front cover 2. The LED is controlled by the microprocessor and driven by the driver 44.

Almost all of the functional paths of the detector can be tested by a stimulus given to the pre-amp input by the test driver 46, and the alarm following the test stimulus is signaled by the alarm output. This also allows a test of the communication within the system. The test driver 46 is also controlled by the microprocessor 42.

Figure 9:
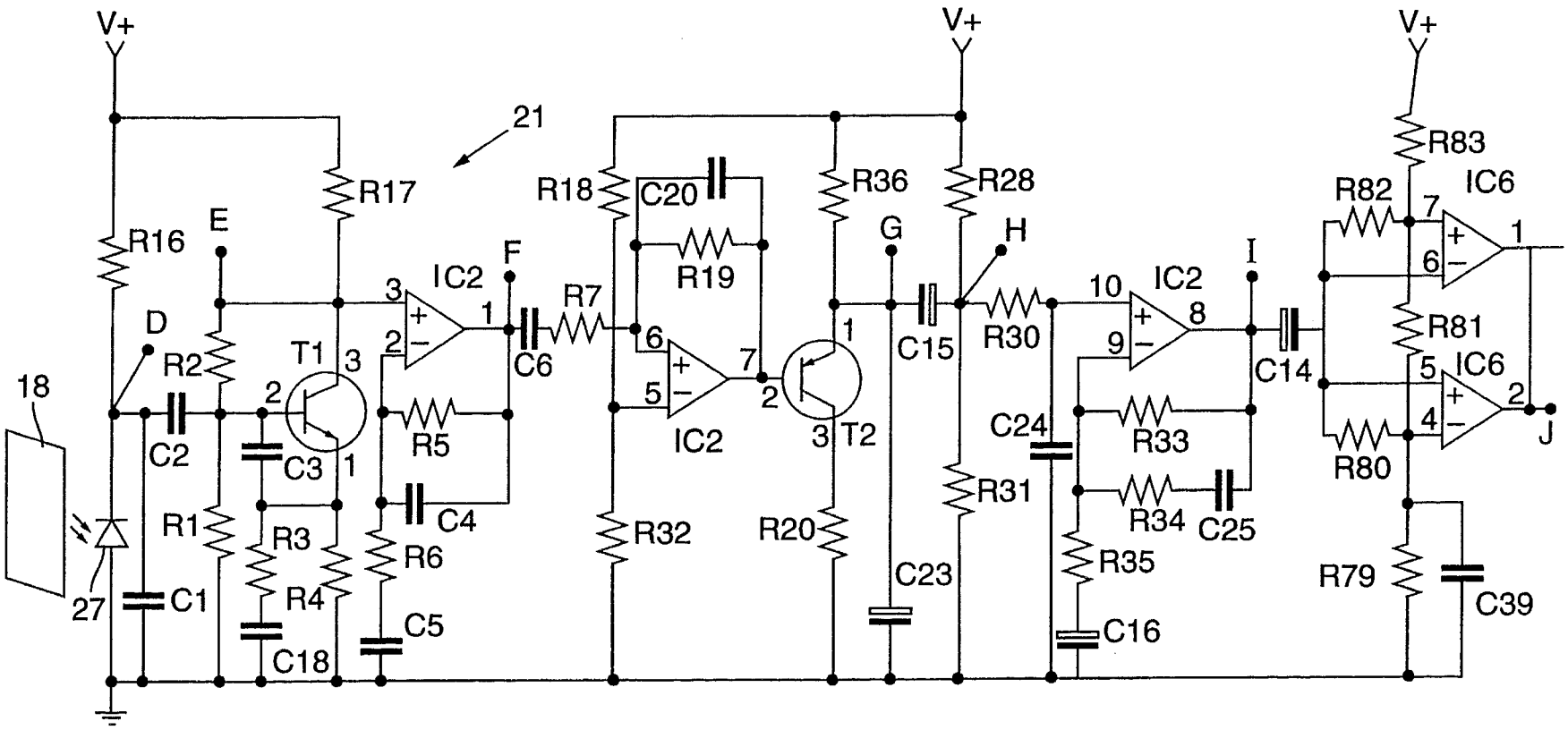
FIG. 9 is a schematic circuit diagram of a near infrared photodiode circuit forming a part of the sensor shown in FIGS. 7*a* and 7*b*.
Figure 10:
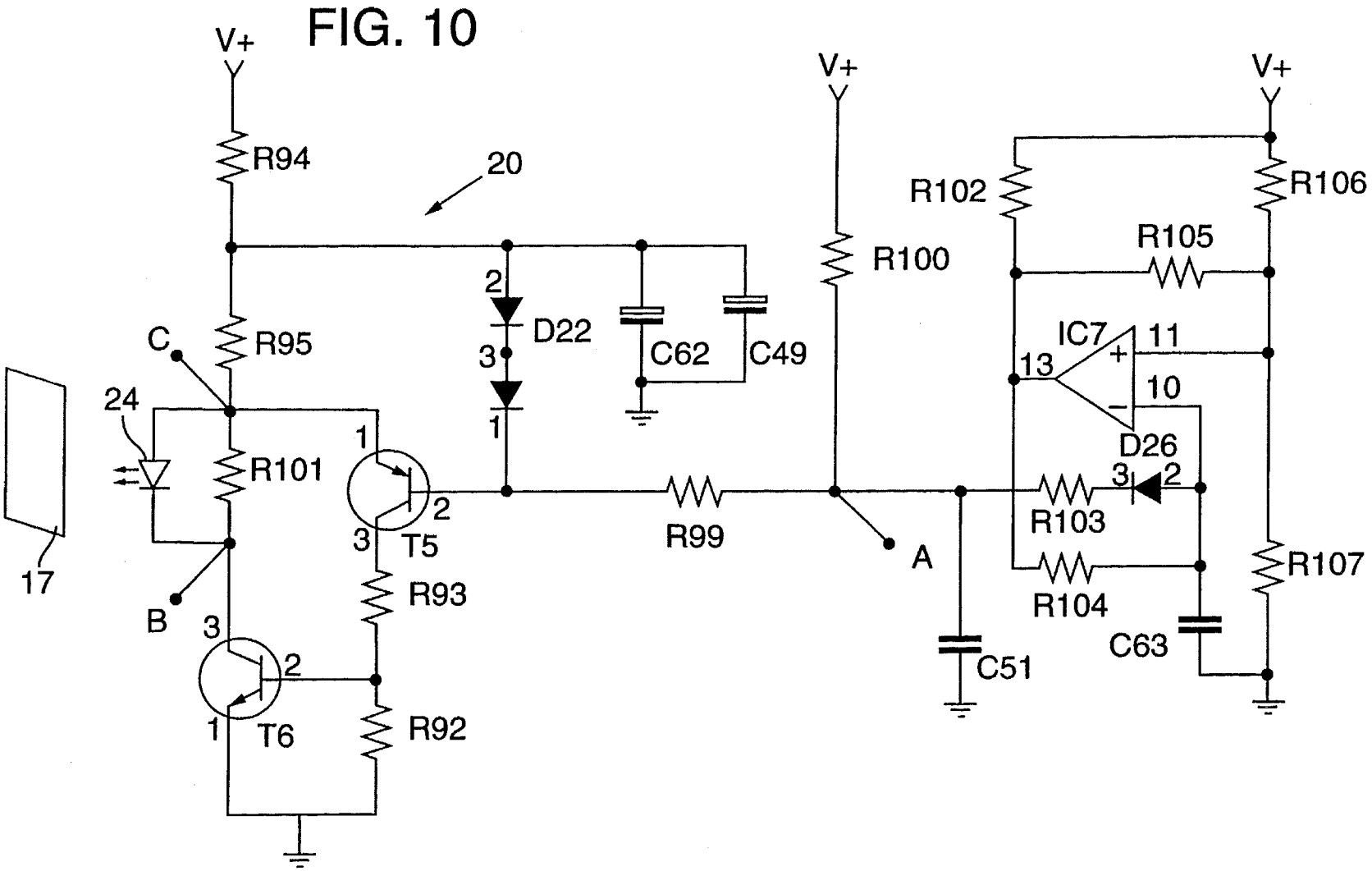
FIG. 10 is a schematic circuit diagram of a near infrared photoemitter circuit forming a part of the sensor shown in FIGS. 7*a* and 7*b*.

The Near Infrared (NIR) optical block 48 includes the infrared photoemitter 24 (for example, a Siemens GaAlAs photoemitter number SFH485P-3; see FIG. 10) used as a NIR light source, and a photodiode 27 (for example, a Siemens PIN photodiode (silicon) number SFH217F; see FIG. 9) is used to quantify any propagation loss which could affect the performance of the alarm sensor. As previously mentioned the propagation can increase or decrease due to the scattering of light against e.g. cardboard or due to spray paint sprayed on the optical surface of the sensor. Once changes in the NIR propagation reach a predetermined threshold a trouble latch will be set indicating masking of the sensor. Masking of the sensor at a short distance with a human hand, glass pane, white paper or spray paint can be detected.

The pulse driver circuit 50 drives the emitter and buffers the oscillator circuit. The NIR photoemitter 24 transmits a NIR light pulse of 2.5 usec, with repetition rate of 800 Hz. This pulse is generated by the oscillator 26, preferably a relaxation oscillator as shown in greater detail in FIG. 10.

The receiver photodiode 27 is continuously biased by the photoemitter diode 24 via the scattering ribs V. If the signal of the oscillator 26 is removed by using the oscillator inhibit (test) section 52, the biasing level disappears, this simulating an attempt at masking. In response to such a test stimulus, controlled by the microprocessor 42, a trouble signal is generated by the trouble output. This allows a test of the wires to the control panel of a system including the PIR sensor of the invention. In this manner the microprocessor 42 automatically tests whether the NIR signal is still present every time the masking latch is reset after a masking attempt.

A pre-amplifier 54 is built up around a low-noise transistor. Across the photodiode 27 is a constant reverse bias voltage. When the background current of the photodiode 27 increases due to increase in ambient light, there is only a slow influence on the bias voltage. For fast changes in the diode current due to the near infrared light current pulses are AC coupled to the pre-amplifier 54, which has a gain of about 30 dB.

The signal of the pre-amplifier 54 is fed to the amplifier 28, preferably a two stage amplifier. Because it is important to have a guaranteed accuracy without any need for calibration, the minimum amplifier bandwidth is preferably determined by resistance-capacitance combinations rather than by amplifier characteristics.

The total gain inclusive of the pre-amplifier 54 preferably is about 62 dB. The high pass pole which is important for ambient light immunity is about 3 KHz and the low pass pole is about 300 KHz.

The NIR signal pulse from the photoemitter 24, received by the photodiode 27, will change in amplitude at a masking attempt. This NIR signal is transformed into a current pulse and after amplification is fed to the peak detector 29.

The frequency characteristic of the amplifier 28 in combination with the peak detector 29 filters out the ambient light fluctuations. A low frequency, anti-masking amplifier 30 has a gain of about 10 dB and a low pass frequency of 2 Hz. The anti-masking amplifier 30 also matches the impedance of the output of the peak detector 29 to the window comparator 31.

The window comparator 31 has symmetrical thresholds. Its output indicates masking or no masking and is fed to the microprocessor 42. Post threshold integration is performed by an integration algorithm in the microprocessor 42.

Masking or technical trouble in the sensor is visibly indicated by the yellow LED 19, which is driven by the yellow LED driver 56, controlled by the microprocessor 42.

The power for the sensor is supplied to terminal 2 (+12 V) and terminal 1 (gnd). A conventional voltage regulator 60 is used for smoothing and regulating the voltage power for the sensor to 6.2 V typical.

The working voltage of the microprocessor 42 is between 2.5 V and 6 V. The microprocessor power supply 58 regulates the voltage to be 5 V typical. It also protects the microprocessor 42 from damage caused by so called "latch up" effects.

To protect the sensor from undefined actions such as "falling in sleepmode" due to slowly decreasing power supply voltage, the unregulated power voltage is continuously monitored by the low voltage detector 62.

The sensor shown has a form A relay output, which is available at terminals 3 and 4. The circuit board of the sensor is also designed for a form C relay. The normally-open contact is in that case available at terminal 5.

The AC coupled relay driver is designed for the microprocessor 42 to be fail safe. The microprocessor 42 generates a square wave output signal. In case of alarm this output will be steady high and the alarm relay will trip its contacts into the non-energized state (alarm state). In case of a trouble with the microprocessor 42 (e.g. reset oscillator stops or the microprocessor 42 "latches up") the output of the microprocessor 42 will be steady high or low and the relay drops its contacts into the alarm state.

The ETO 64 is an electronic trouble output which does not respond to intruder motion but signals those events that could impair motion detection, such as masking attempts, technical malfunctions and low voltage. In the case of one of these trouble signals the ETO will become conductive to ground. When the trouble condition is restored the ETO goes to the non conductive state.

A test input buffer 66 is provided so that the complete sensor, exclusive of the pyro-electric element 11, can be tested. The signal from test input buffer 66 is fed to the microprocessor 42, and a test input delay is made up in the microprocessor.

The 84C12 microprocessor 42 controls all the logical functions for the alarm algorithm, the trouble signal algorithm, the red alarm LED 4, the yellow trouble LED 19, the alarm relay, the ETO 64, the EAM signals and the test sequence.

A reset oscillator 68 generates a positive reset pulse of about 1 msec every 27 msec. (typical) and is connected to the reset input of the microprocessor 42 to protect against running in an undefined loop. The reset oscillator 68 thus functions as a watchdog oscillator.

Three switches, SW1, SW2, and SW3, are provided to control sensor operation.

SW1 controls the operation of the trouble (masking detection) hold function. When this switch is closed (trouble hold off) a trouble signal is signaled by the ETO 64 in day and/or night mode (latch or not latch) of the sensor. If the switch SW1 is open (trouble hold on) a trouble signal is signaled only during day mode (not latch) of the sensor. If a masking attempt has been made while the sensor was in night mode, the ETO 64 would be switched to a conductive state, indicating trouble, when the sensor is later switched from night to day mode.

SW2 controls the operation of the event verification (EV) selection function. With this switch a selection can be made between EV off and EV on. When EV is on the microprocessor 42 uses criteria based on PIR target signal characteristics to verify an alarm event. The EV off mode is chosen when the switch is closed and when the switch is open the EV on mode is selected.

SW3 allows the sensor to be programmed to signal a masking attempt via the alarm relay. This mode can be chosen to reduce the required number of wires to the sensor or to have a highly secure trouble signal. The "trouble to relay" selection follows the "trouble hold" input from switch SW1. That means that in the case trouble hold mode is "on" (this means trouble signaling only during day mode) the trouble will be signaled through the ETO 64 and the alarm relay, but only when the sensor is in day mode.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An obstruction resistant alarm system for detecting the presence of an intruder in a location being monitored, comprising:

a housing including a selectively transmissive window that transmits radiation within a first wavelength range and scatters radiation within a second wavelength range;

an intrusion sensor positioned to receive from an intruder radiation of wavelengths within the first wavelength range passing through the window, the intrusion sensor producing in response to the radiation within the first wavelength range a presence signal indicative of the presence of the intruder in proximal location to the intrusion sensor;

a radiation source emitting and a radiation detector detecting radiation within the second wavelength range, the radiation source positioned to direct the radiation within the second wavelength range to strike and then be scattered by the window and the radiation detector positioned to detect the radiation within the second wavelength range striking and scattered by the window, such that the radiation within the second wavelength range emitted by the radiation source and scattered by the window forms a normal radiation pattern having a normal intensity detected by the radiation detector whenever the window is unobstructed and an abnormal radiation pattern having an abnormal intensity detected by the radiation detector whenever the window is obstructed; and an alarm circuit operatively connected to the radiation detector to produce an alarm signal in response to detection by the radiation detector of radiation intensity corresponding to an abnormal radiation pattern to indicate an obstruction of the window and a consequent compromise to the reliability of the presence signal produced by the intrusion sensor.

2. The alarm system of claim 1 in which the window has an exterior surface and opposed sides, and in which the housing further comprises wings positioned on the housing proximally to the opposed sides and extending outwardly from the exterior surface of the window, the window and the wings cooperating to scatter radiation within the second wavelength range to form the normal radiation pattern by providing more than one path that radiation can travel from the radiation source to the radiation detector.

3. The alarm system of claim 1 in which the second wavelength range is 0.35 to 4 μm.

4. The alarm system of claim 1 in which the first wavelength range is 6 to 50 μm.

5. The alarm system of claim 1 in which the radiation source comprises a photoemitter and the radiation detector comprises a photodiode, each having an angle of opening of between 60° and 120°.

6. The alarm system of claim 1 in which the window is fabricated from high density polyethylene.

7. The alarm system of claim 1 in which the window includes a textured surface that scatters radiation within the second wavelength range.

8. The alarm system of claim 1 in which the window has an exterior surface and in which each of the radiation source and the radiation detector is positioned to point at the window at an angle of less than 20° with respect to the exterior surface of the window.

9. The alarm system of claim 1 in which the window includes a bottom side having a center and in which the radiation source and the radiation detector are focused to, respectively, direct radiation toward and receive radiation from the center of the bottom side of the window.

10. The alarm system of claim 1 in which the radiation source comprises a pulsed photoemitter that emits pulses of radiation having amplitude peaks and in which the radiation detector cooperates with a peak detector to detect the amplitude peaks of the radiation pulses, the alarm system further comprising a synchronizer operatively connected to the pulsed photoemitter and the peak detector to periodically energize the peak detector in synchronism with the emission of radiation pulses to significantly increase the signal-to-noise ratio of the alarm system.

* * * * *